US012241363B2

(12) United States Patent
Schiermeier et al.

(10) Patent No.: US 12,241,363 B2
(45) Date of Patent: Mar. 4, 2025

(54) STEERABILITY OF DOWNHOLE RANGING TOOLS USING ROTARY MAGNETS

(71) Applicant: Halliburton Energy Services, Inc., Houston, TX (US)

(72) Inventors: Pete L. Schiermeier, Houston, TX (US); Sean Hinke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/653,198

(22) Filed: Mar. 2, 2022

(65) Prior Publication Data

US 2023/0088047 A1 Mar. 23, 2023

Related U.S. Application Data

(60) Provisional application No. 63/244,414, filed on Sep. 15, 2021.

(51) Int. Cl.

| | |
|---|---|
| ***E21B 47/0228*** | (2012.01) |
| ***E21B 7/06*** | (2006.01) |
| ***E21B 47/092*** | (2012.01) |
| ***G01V 3/26*** | (2006.01) |

(52) U.S. Cl.
CPC ..... *E21B 47/0228* (2020.05); *E21B 7/06* (2013.01); *E21B 7/067* (2013.01); *E21B 47/092* (2020.05); *G01V 3/26* (2013.01)

(58) Field of Classification Search
CPC ..... E21B 7/06; E21B 47/092
See application file for complete search history.

(56) References Cited

U.S. PATENT DOCUMENTS

| | | | | |
|---|---|---|---|---|
| 5,258,755 | A * | 11/1993 | Kuckes | G05D 1/0261 175/45 |
| 5,484,029 | A * | 1/1996 | Eddison | E21B 7/068 175/73 |
| 5,589,775 | A * | 12/1996 | Kuckes | E21B 47/0228 175/45 |
| 11,193,363 | B2 * | 12/2021 | Melo Uribe | E21B 47/024 |
| 2002/0050930 | A1 | 5/2002 | Thomeer et al. | |
| 2006/0028321 | A1 * | 2/2006 | Kennedy | E21B 47/092 340/385.1 |

(Continued)

FOREIGN PATENT DOCUMENTS

| | | | |
|---|---|---|---|
| AU | 2005269214 | B2 | 2/2006 |
| EP | 1792052 | B1 | 8/2010 |

(Continued)

OTHER PUBLICATIONS

Search Report and Written Opinion issued for International Patent Application No. PCT/US2022/070916, dated Jun. 13, 2022, ISA/KR, 11 pages.

(Continued)

*Primary Examiner* — Nicole Coy
*Assistant Examiner* — Nicholas D Wlodarski
(74) *Attorney, Agent, or Firm* — Benjamin Ford; C. Tumey Law Group PLLC

(57) ABSTRACT

A ranging system having magnets positioned at various locations along the drive system. Location of the magnetics is shifted to different points on the drilling string to remove the need for a nearby bit sub that would detrimentally affect the steerability of the drilling system.

20 Claims, 5 Drawing Sheets

(56) References Cited

U.S. PATENT DOCUMENTS

| | | | | |
|---|---|---|---|---|
| 2006/0113803 | A1* | 6/2006 | Hall | F03B 13/02 290/54 |
| 2006/0151179 | A1* | 7/2006 | Boyadjieff | E21B 41/0085 166/380 |
| 2011/0088890 | A1 | 4/2011 | Clark | |
| 2012/0139543 | A1* | 6/2012 | McElhinney | E21B 47/0228 324/346 |
| 2013/0173164 | A1 | 7/2013 | Zhang | |
| 2013/0341092 | A1 | 12/2013 | Hay et al. | |
| 2014/0069721 | A1 | 3/2014 | Clark et al. | |
| 2015/0378043 | A1 | 12/2015 | Brooks | |
| 2017/0138173 | A1* | 5/2017 | Estes | E21B 47/092 |
| 2017/0254189 | A1 | 9/2017 | Tamboise | |
| 2018/0038218 | A1 | 2/2018 | Hay | |
| 2019/0169935 | A1 | 6/2019 | Spatz et al. | |
| 2019/0316444 | A1* | 10/2019 | Entchev | E21B 31/00 |
| 2019/0353031 | A1 | 11/2019 | Logan et al. | |
| 2019/0368287 | A1 | 12/2019 | Shekhar et al. | |
| 2020/0080381 | A1* | 3/2020 | Hardin, Jr. | E21B 17/16 |
| 2021/0008697 | A1 | 1/2021 | Mueckl et al. | |

FOREIGN PATENT DOCUMENTS

| | | | |
|---|---|---|---|
| TW | 201202730 | A | 1/2012 |
| TW | 201307877 | A | 2/2013 |
| TW | 201337306 | A | 9/2013 |
| TW | 201344230 | A | 11/2013 |
| TW | 202001288 | A | 1/2020 |

OTHER PUBLICATIONS

Taiwan Office Action for TW Patent Application No. 111120034 received Feb. 17, 2023.

European Office Action for Application No. 22189758.0 dated Dec. 8, 2022.

Singapore Search Report and Written Opinion for SG Patent Application No. 10202203775S dated Aug. 28, 2024. PDF file. 6 pages.

* cited by examiner

STEERABILITY OF DOWNHOLE RANGING TOOLS USING ROTARY MAGNETS

PRIORITY

The present application claims priority to U.S. Provisional Application No. 63/244,414, filed on Sep. 15, 2021, having the same title, the benefit of which is claimed and the disclosure of which is incorporated herein by reference in its entirety.

FIELD OF THE INVENTION

The present invention relates generally, but not limited to, hydrocarbon exploration using magnetic ranging assemblies and, more specifically, to methods and systems to improve the steerability of ranging tools using rotary magnets.

BACKGROUND

Hydrocarbons, such as oil and gas, are commonly obtained from subterranean formations that may be located onshore or offshore. The development of subterranean operations and the processes involved in removing hydrocarbons from a subterranean formation can be complex. Typically, subterranean operations involve a number of different operations such as, for example, drilling a wellbore at a desired well site, treating the wellbore to optimize production of hydrocarbons, and performing the necessary operations to produce and process the hydrocarbons from the subterranean formation.

Ranging tools are used to determine the position, direction, and orientation of a conductive pipe (for example, a metallic casing) for a variety of applications. In certain instances, such as in a blowout, it may be necessary to intersect a first well, called a target well, with a second well, called a relief well. The second well may be drilled for the purpose of intersecting the target well, for example, to relieve pressure from the blowout well. In certain instances, such as a crowded oil field, it may be necessary to identify the location of multiple wells to avoid collision incidents. In other examples, the ranging tool can be used to drill a parallel well to an existing well, for example, in steam assist gravity drainage ("SAGD") well structures. In yet other examples, a ranging tool can be used to track an underground drilling path using a current injected metallic wire or pipe over the ground as a reference.

One of the disadvantages of conventional ranging tools is their requirement to have the magnetic bit sub between the drill bit and driveshaft of the rotary steerable tool or mud motor. Placement of the magnetic bit sub in these positions limit the steerability of the ranging tools.

DESCRIPTION OF ILLUSTRATIVE EMBODIMENTS

Figure 1:
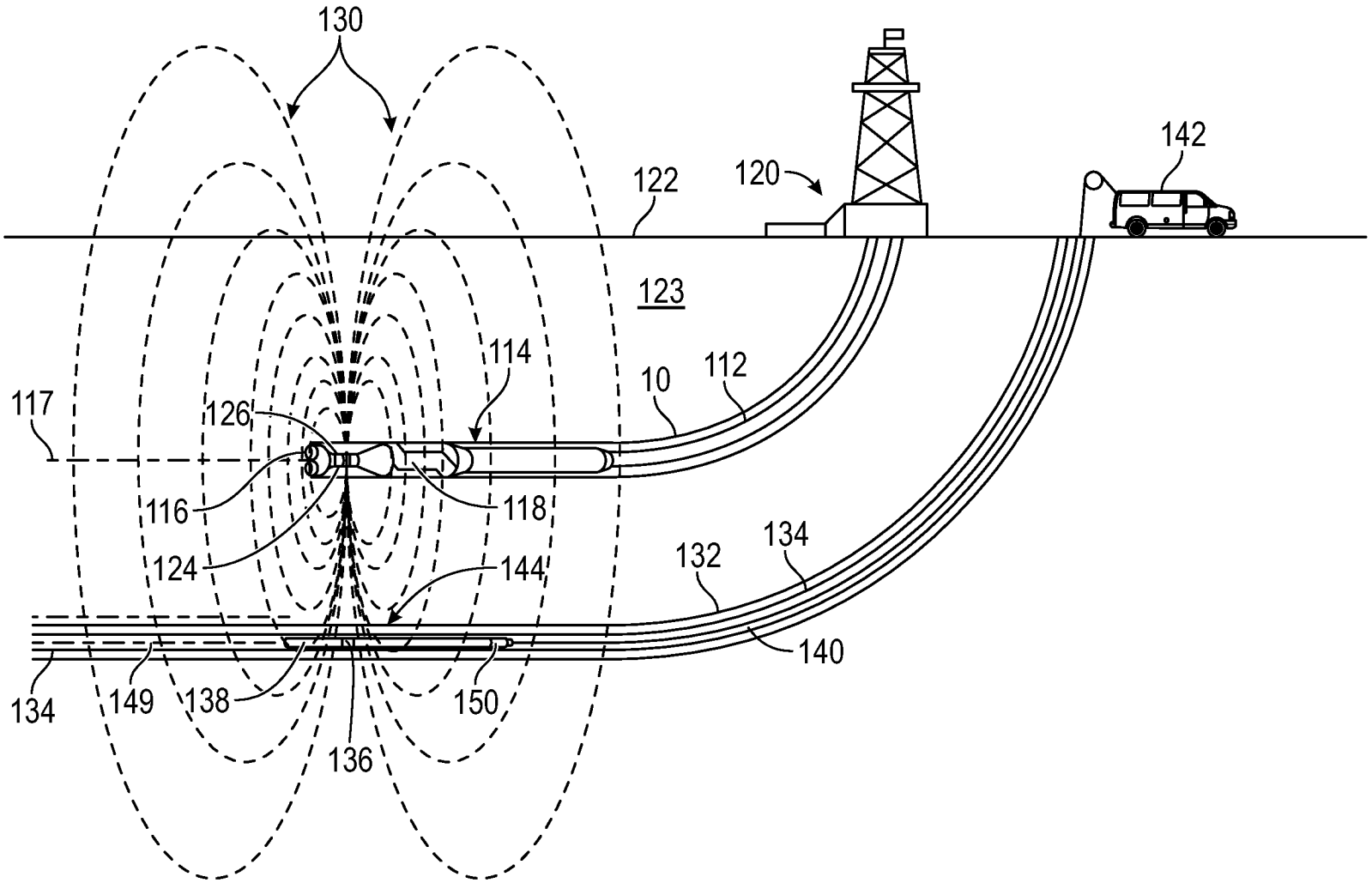
FIG. 1 illustrates a ranging system, according to an illustrative embodiment of the present disclosure.

Illustrative embodiments and related methods of the present disclosure are described below as they might be employed to provide improve steerability of downhole ranging tools using rotary magnets. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

As mentioned above, one major disadvantage of conventional ranging is their requirement to have a magnetic bit sub between the drill bit and driveshaft of the rotary steerable tool ("RSS") or mud motor. However, placing the magnetic bit sub here limits the steerability of the ranging tool. At the same time, however, it is best to know where the bottom of the hole is as close to the magnets as possible. As a result, the magnets should be positioned nearest the bottom of the hole (or the bit) as possible. However, the conventional approach (placement of the magnetic bit sub between the drill bit and driveshaft) has resulted in limited steerability.

Accordingly, in response to this limitation in conventional approaches, illustrative embodiments of the present disclosure position ranging magnets in the bit box and other locations along the rotary steerable system/mud motor/turbo drill or any other drive system. Location of the magnetics is shifted to different points on the drilling tools to remove the need for a nearby bit sub that would detrimentally affect the steerability of the drilling system by keeping the length shorter or the same as originally intended and designed.

In certain embodiments, the magnets can also be mounted on an independent member of a rotating drill string driven by a drive system. Positioning the magnets in these locations allow for a shorter bend to bit or reaction point to bit which enables better steering. Therefore, magnets are integrated into the body of the tools above the drill bit such as the RSS/turbo drill/motor or downhole drive. This removes the need for a bit sub.

In certain other embodiments, the magnets should not increase the length of reaction point to bit or the magnets should be put above the reaction point. The reaction point would be the knuckle of the bent housing on a motor or a stabilizer point or a contact point above the bit (such as a push pad on a rotary steerable system). In yet other embodiments, the magnets could be on the push pads themselves.

Accordingly, the illustrative embodiments of the present disclosure eliminate the need to place the magnetic bit sub between the drill bit and the driveshaft of the rotary steerable tool or mud motor. The embodiments described herein instead position one or more ranging magnets along the rotary steerable tool, motor, or the drill bit. In one illustrative embodiment, the one or more magnets are positioned in the bit box of the drive shaft or either tool (rotary steerable tool or mud motor). By placing the magnets here, no unnecessary length is added (and/or the added length is minimized) relative to the bit sub. As a result, the integrity of the steerability of the tool (rotary steerable system/motor) is maintained while keeping the positioning of the magnetics near the bottom of the bottom hole assembly.

FIG. 1 diagrammatically illustrates one ranging system in accordance with the present invention for guiding directional drilling of a second borehole to achieve precisely controlled separation with respect to a first, previously drilled borehole. In FIG. 1, borehole 110 contains a tubular drill string 112 incorporating a drill assembly generally indicated as bottomhole assembly 114. The drill assembly includes a drill bit 116 which is driven by suitable motors 118 (drive system) in conventional manner, to rotate about a longitudinal axis of rotation 117, the drill bit being steerable to control the direction of drilling in response to control signals from a control station 120 located at the surface 122 of the earth 123. In this example, the drive system is located downhole; however, in other examples the drive system may also be located at surface 122.

In accordance with this example, an elliptically polarized rotating magnetic field is generated in the borehole being drilled. For this purpose, the drill assembly 114 carries one or more magnetic field sources such as a ranging magnet 124 mounted in a non-magnetic piece of drill pipe 126 (also referred to as a sub) located behind the rotating drill bit 116 or otherwise along the bottomhole assembly as described herein. The ranging magnet is carried by the drill string 112 with north-south axes of the magnet perpendicular to the axis of rotation 117 of the drill bit 116. This bar magnet generates an elliptically polarized magnetic field generally indicated by the magnetic field lines 130, with the rotation of the magnet 124 about axis 117 producing an alternating magnetic field at an observation point radially spaced from the magnet.

An existing borehole 132 is illustrated in FIG. 1. This borehole 132 is illustrative of a horizontal well of the type which may be used for steam assisted gravity drainage of heavy oil. The borehole 132, which may include a casing 134, is a target well which is to be followed by the borehole 110 being drilled. In accordance with one example of the present invention, the drill bit 116 is controlled so that the borehole 110 is drilled directly above borehole 132 and is spaced above it by a predetermined, constant distance. Control of the drill bit 116 is carried out in response to measurements made in the target borehole 132 by means of a magnetic field sensor 36 located in a measuring tool 138. In this example, the measuring tool is lowered into the borehole 132 through casing 134 by means of a suitable wireline 140, with the location, or depth, of the measuring tool being controlled from the earth's surface in conventional manner from an equipment truck 142.

The magnetic field sensor 136 is located at an observation point 144 and incorporates, in this illustrative embodiment, a pair of fluxgate magnetometers having their axes of maximum sensitivity intersecting each other at the observation point and at right angles to each other. The magnetometers measure the amplitude and the phase of two perpendicular components of the polarized rotating magnetic field 130 which are both perpendicular to a longitudinal axis 149 of the measuring tool 138. The measuring tool also incorporates, in one form of the invention, an orientation sensor 150 for determining the orientation of the magnetic field sensor 136 with respect to either the borehole or to magnetic north. Such orientation devices may include, for example, earth's field sensors, inclinometers, and/or a gyroscope.

Although FIG. 1 shows ranging magnet 124 positioned just behind the bit (in a magnet sub), the present disclosure describes many other locations in which one or more ranging magnets may be located. As a result, the need for placing a magnetic bit sub between the drill bit and the driveshaft of the rotary steerable tool or mud motor is eliminated. Moreover, FIG. 1 illustrates a rotary steerable system ("RSS"). However, embodiments of the present disclosure may be used with other drive systems such as, for example, mud motor based systems.

Figure 2:
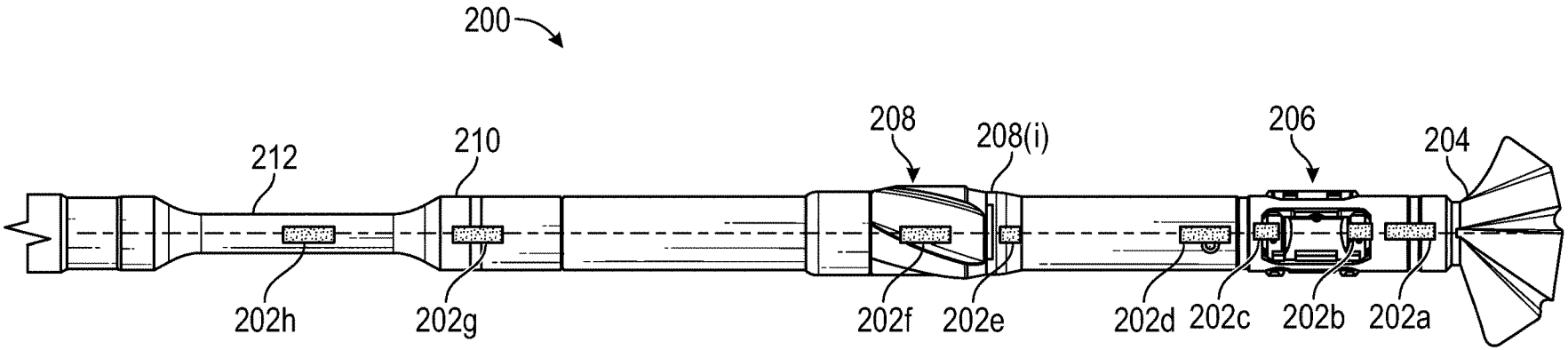
FIG. 2 illustrates a push-the-bit rotary steerable system according to certain illustrative embodiments of the present disclosure.

In view of the foregoing, FIG. 2 illustrates a push-the-bit RSS according to certain illustrative embodiments of the present disclosure. FIG. 2 illustrates a number of ranging magnets 202*a-h* positioned at various locations along the RSS 200. In this and the following example, one or more of ranging magnets 202*a-h* may be positioned along the tubular string at various locations. For example, a ranging magnet 202*a* may be positioned between the bit box/drill bit 204 and pad assembly 206 (of the steering collar). In another example, ranging magnets 202*b* and 202*c* may be positioned in the push pads (e.g., non-movable pads) of pad assembly 206. In yet another example, ranging magnet 202*d* can be positioned just above pad assembly 206.

In other examples, a ranging magnet 202*e* can be positioned on the shoulder threads 208(*i*) of a stabilizer sleeve 208. In other example, a ranging magnet 202*f* can be placed on the outer surface of a thread on stabilizer sleeve 208 (or below the thread on stabilizer sleeve 208).

In yet other examples, the ranging magnets can be placed along a bit box 210 of a flex collar 212. For example, a ranging magnet 202*g* is positioned on the pin end of bit box 210. In another example, ranging magnet 202*h* is positioned in the middle of flex collar 212. In such examples, a communications/data link (not shown) would exist and pass through the flex collar to enable communications and/or power transfer along the RSS.

Figure 3:
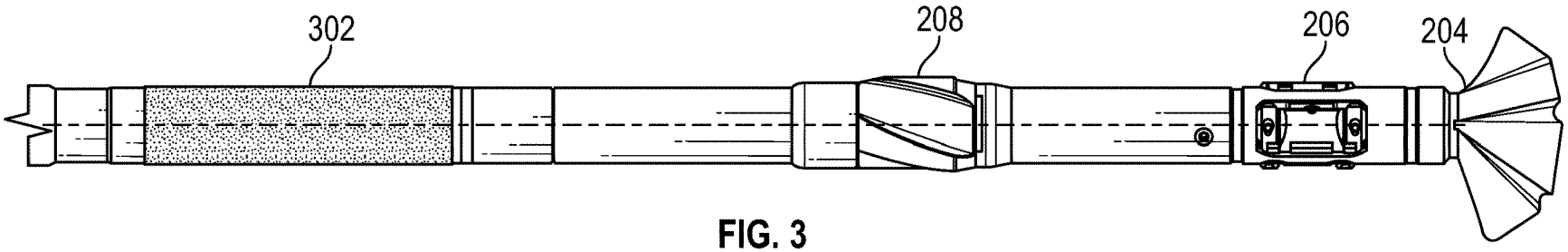
FIG. 3 illustrates an alternative embodiment in which a magnetic sub is positioned along the drive system.

FIG. 3 illustrates an alternative illustrative embodiment of the present disclosure. In this example, instead of the flex collar, a sub 302 is positioned in its place. The sub 302 would be a rigid collar-like component (or some other continuous outer diameter component) which houses one or more ranging magnets. As in the embodiment of FIG. 2, the sub 302 of FIG. 3 would also include a communications/power transfer link running therethrough.

Figure 4:
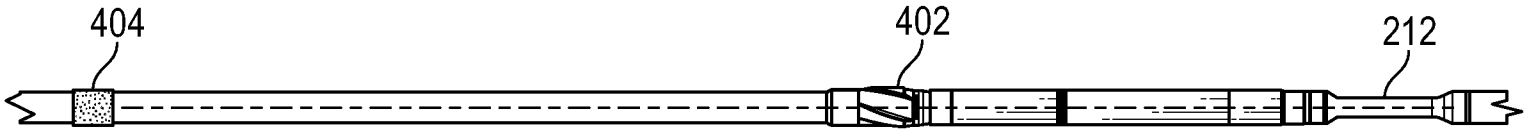
FIG. 4 illustrates an alternative embodiment in which the ranging magnets are positioned above the rotary steerable system in a separate collar.
Figure 5:
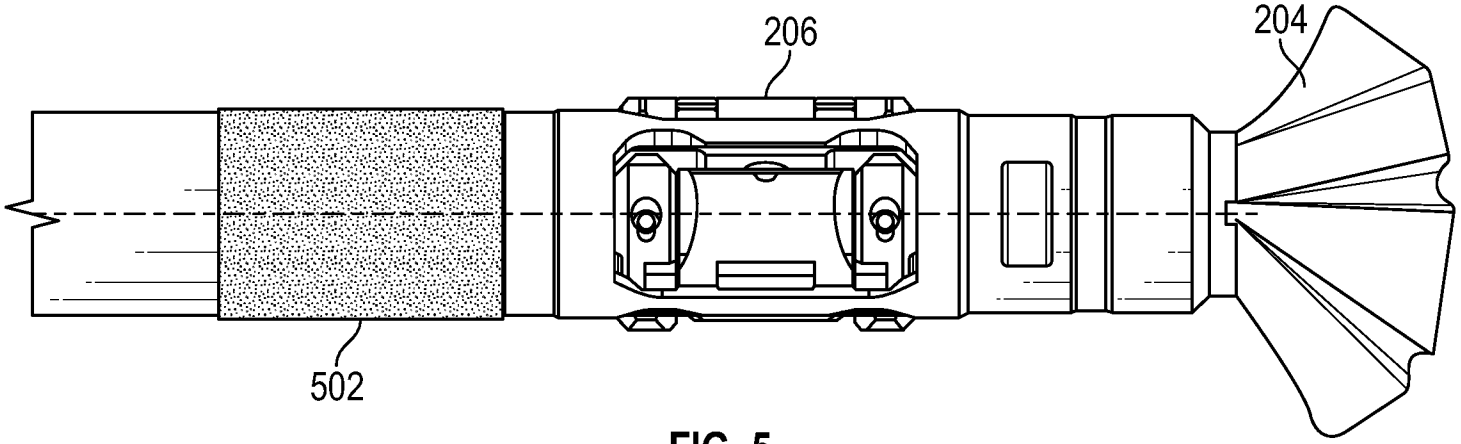
FIG. 5 illustrates yet another embodiment in which the ranging magnet(s) are positioned in a separate collar located just above the steering collar.

FIG. 4 illustrates yet another alternative embodiment in which the magnet(s) can be positioned above the RSS tool in a separate collar. Here, the RSS also includes a second stabilizer collar 402 above flex collar 212. A separate magnetic collar 404 is positioned above second stabilizer collar 402. FIG. 5 illustrates yet another embodiment in which the ranging magnet(s) are positioned in a separate collar 502 located just above the steering collar.

Figure 6:
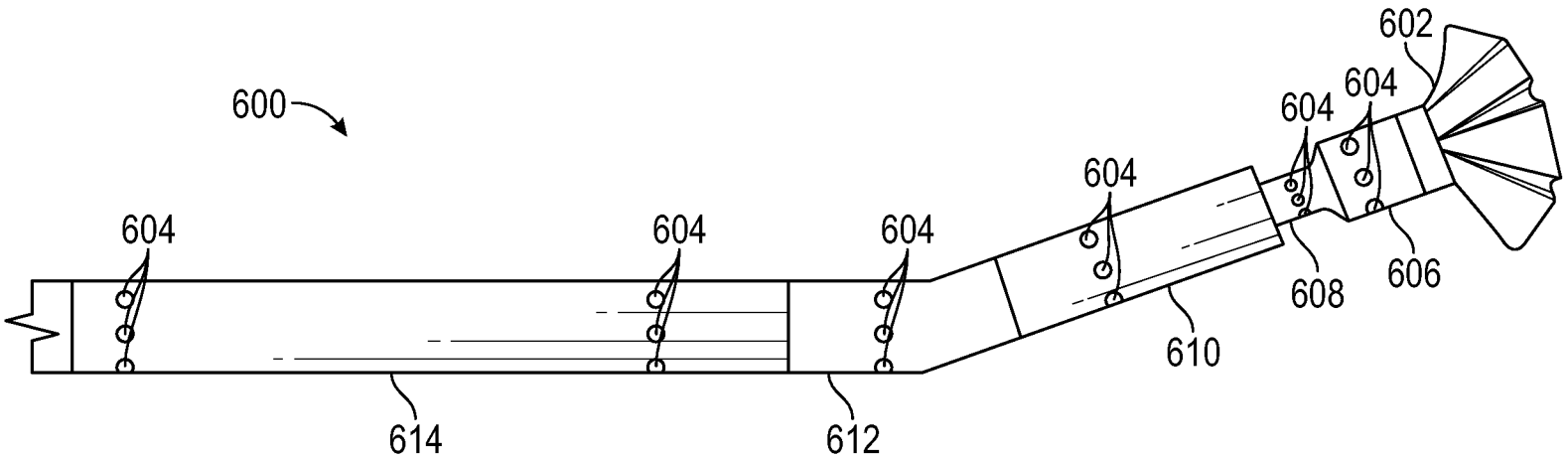
FIG. 6 illustrates a downhole motor assembly having one or more ranging magnets positioned thereon.

FIG. 6 illustrates an alternative embodiment of the present disclosure applicable to downhole motor assemblies. In this example, motor assembly 600 includes a drill bit 602 and multiple ranging magnets 604 are shown positioned around the tubular at various positions. As shown, multiple ranging magnets 604 may be positioned around bit box 606, drive shaft 608, bearing assembly 610, bent housing assembly 612, or stator tube 614.

Figure 7A:
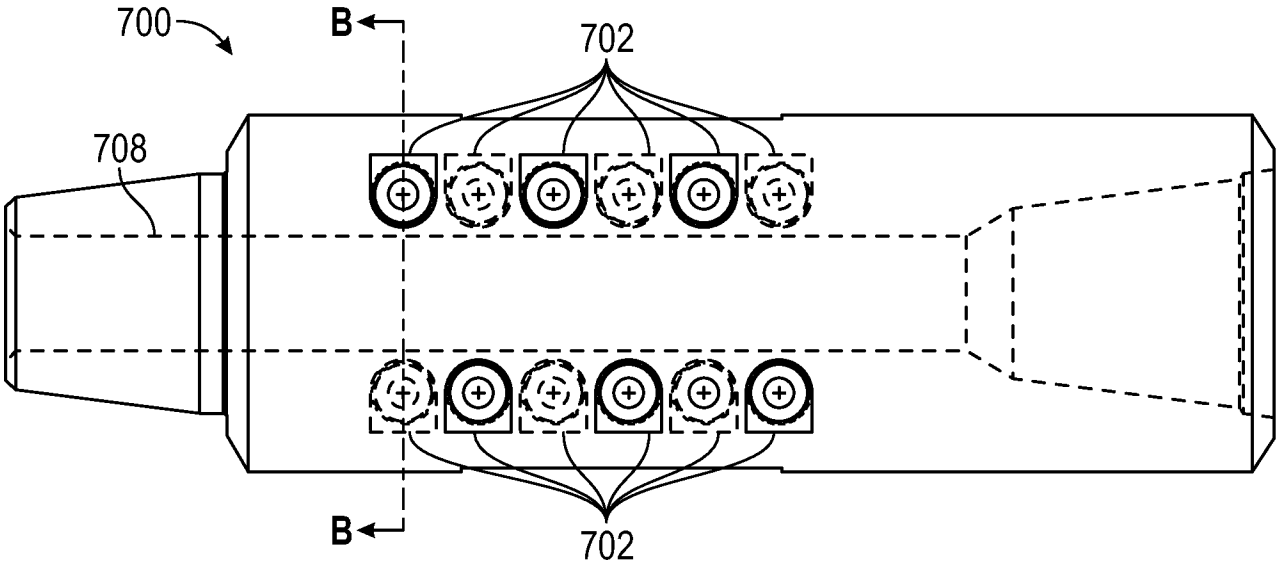
FIGS. 7A, 7B and 7C illustrate various views of possible placement/orientation of the ranging magnets along the bottomhole assembly.
Figure 7B:
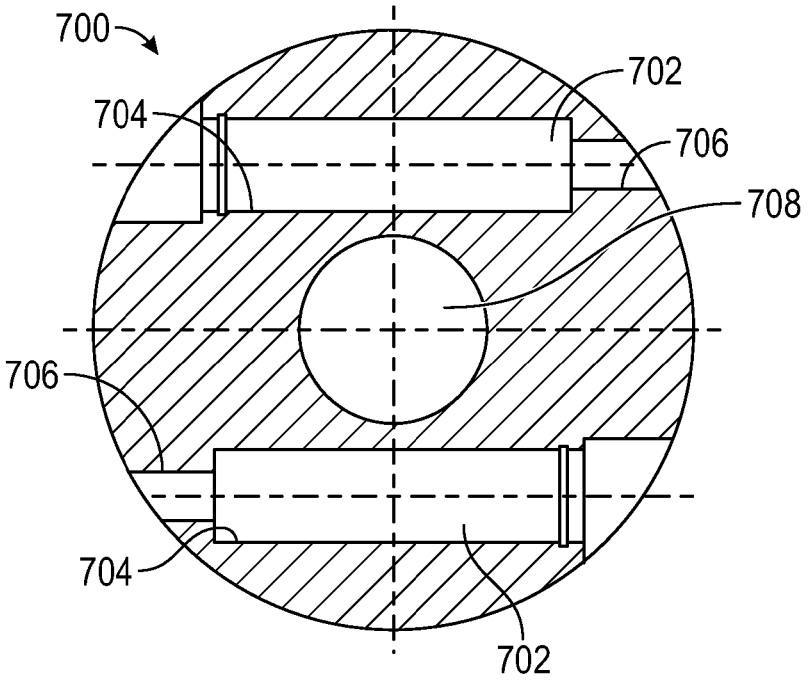
Figure 7C:
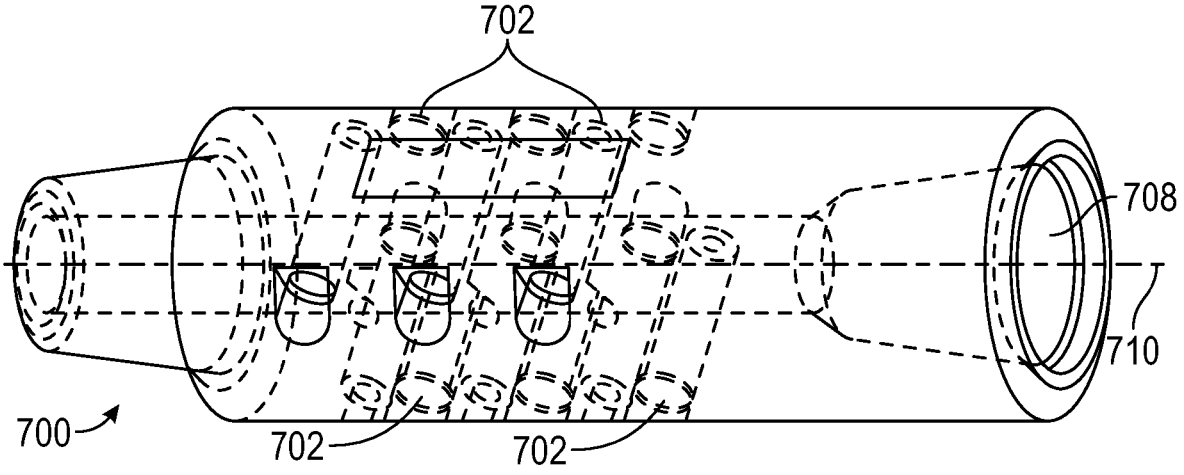

In these examples, the ranging magnets may be embedded in pockets and offset from the center line of the tube. The thickness of the side walls of the tubular dictate how many magnets are needed to generate the desired magnetic signatures. FIGS. 7A, 7B and 7C illustrate various views of possible placement/orientation of the ranging magnets along the BHA. FIG. 7A illustrates a three-dimensional perspective view of a tubular component 700 having multiple ranging magnets 702 embedded therein. FIG. 7B is a sectional view of component 700 along line B-B. In this example, you can see bores/pockets 704 have been machined into the body of component 700. A sub-bore 706 is also machined into component 700 along the same axis as bore 704. The purpose of sub-bore 706 is to provide a small pilot hole before opening up to the necessary size to allow for easy removal of magnets as required via pushing through sub-bore 706 with a small pipe or some other suitable component. The ranging magnets 702 are secured inside bore 702 by, for example, snap rings and/or an epoxy, or some other suitable securing means. As can be seen, the magnets may be positioned laterally with respect to the tool axis (offset from the centerline of bore 708). FIG. 7C is another perspective view of component 700 showing the ranging magnets 702 oriented laterally with respect to the axis 710 of component 700.

In yet another alternative embodiment, multiple magnet subs may be added above and below the downhole drive system (e.g., mud motor, turbine, electric motor or others). For example, ranging magnets may be positioned between the bit box and push pad assembly (FIG. 2) and also along a drive motor such as 600 (FIG. 6). In such embodiments, a mechanical mechanism is used to alter the frequency of the magnetic field being created downhole through drillstring rotation from the surface alone, rotation from drillstring in combination with downhole drive rotation, or through rotation from downhole drive only. With this, magnet subs of different length and therefore different strengths can be engaged and disengaged [through selection of which rotation method is being applied] depending on the needs of the operation. For example, a large magnet sub placed above the downhole drive can (when rotated) be utilized for long range location of wells.

If an intersection is required at some point in a wellbore pairing, the rotation above the downhole drive can be disengaged and the downhole drive (via mud motor, rotary steerable, electric motor, or others) can be utilized to rotate a small magnet sub located close to the bit without interference and saturation of the magnetometers in an adjacent well due to rotation at close proximities.

These functions described above can be implemented in digital electronic circuitry, in computer software, firmware, hardware or other suitable control circuitry. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Such control circuitry may be located at the surface (e.g., equipment truck 142) or downhole along the drill string. The control circuitry includes processing circuitry necessary (i.e., system control center) to achieve the ranging techniques described herein in real-time. Such circuitry includes a communications unit to facilitate interaction between the drilling system and a remote location (such as the surface). A visualization unit may also be connected to communications unit to monitor the ranging measurement data being processed; for example, an operator may intervene the system operations based on this data. A data processing unit may convert the received data into information giving the target's position, direction and orientation in real-time. Thereafter, results may be displayed via the visualizing unit.

The system control center also includes the storage/communication circuitry necessary to perform the calculations described herein. In certain embodiments, that circuitry is communicably coupled to sensors 136 and BHA 114 in order to process the received electromagnetic fields. Additionally, the control circuitry (if positioned along the BHA 114) may be communicably coupled via wired or wireless connections to the surface to thereby communicate data back uphole and/or to other assembly components (to steer a drill bit 116 forming part of assembly 114, for example). In an alternate embodiment, the system control center or other circuitry necessary to perform one or more aspects of the techniques described herein may be located at a remote location away from BHA 114, such as the surface or in a different wellbore. In other embodiments, the electromagnetic field measurements may be communicated remotely to the system control center for processing. These and other variations will be readily apparent to those ordinarily skilled in the art having the benefit of this disclosure.

Moreover, the on-board circuitry includes at least one processor and a non-transitory and computer-readable storage, all interconnected via a system bus. Software instructions executable by the system control center for implementing the illustrative relative positioning methods described herein in may be stored in local storage or some other computer-readable medium. It will also be recognized that the ranging software instructions may also be loaded into the storage from a CD-ROM or other appropriate storage media via wired or wireless methods.

Moreover, those ordinarily skilled in the art will appreciate that various aspects of the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Methods and embodiments described herein further relate to any one or more of the following paragraphs:

1. A downhole ranging tool, comprising a tubular string having a bottomhole assembly ("BHA") comprised of a drive system and drill bit; and one or more ranging magnets positioned along the tubular string.

2. The downhole ranging tool as defined in paragraph 1, wherein the ranging magnets are positioned in a drill bit box of the drive system; or the ranging magnets are positioned between a drill bit box and push pads of the drive system.

3. The downhole ranging tool as defined in paragraph 1 or 2, wherein the ranging magnets are positioned in a pad assembly of the drive system or above the pad assembly of the drive system; or the ranging magnets are positioned on a stabilizer sleeve of the drive system.

4. The downhole ranging tool as defined in any of paragraphs 1-3, wherein the ranging magnets are positioned on a flex collar of the drive system; or the ranging magnets are positioned in a flex collar positioned above a stabilizer sleeve.

5. The downhole ranging tool as defined in any of paragraphs 1-4, wherein the drive system is a push-the-bit rotary steerable system ("RSS").

6. The downhole ranging tool as defined in any of paragraphs 1-5, wherein the magnets are positioned in a collar above the RSS.

7. The downhole ranging tool as defined in any of paragraphs 1-6, wherein the drive system is a downhole motor assembly.

8. The downhole ranging tool as defined in any of paragraphs 1-7, wherein the magnets are positioned on a bit box, drive shaft, bearing assembly, bent housing assembly or a stator tube of the downhole motor assembly.

9. The downhole ranging tool as defined in any of paragraphs 1-8, wherein the magnets are embedded in pockets of side walls of the tubular string, the pockets being offset from a center line of the tubular string.

10. The downhole ranging tool as defined in any of paragraphs 1-9, wherein the pockets are oriented laterally with respect to an axis of the tubular string.

11. The downhole ranging tool as defined in any of paragraphs 1-10, wherein the ranging magnets are located in two or more subs positioned above and below the drive system; and a frequency of the subs is altered through rotational engagement and disengagement of the subs, thereby altering the frequency of magnetic fields generated by the subs.

12. A downhole ranging method, comprising generating, by way of one or more ranging magnets positioned along a tubular string in a first wellbore, a magnetic field; measuring the magnetic field using one or more sensors in a second wellbore; and determining, from the measuring, a range of the first wellbore relative to the second wellbore.

13. The downhole ranging method as defined in paragraph 12, wherein the ranging magnets are positioned in a drill bit box of the drive system; or the ranging magnets are positioned between a drill bit box and push pads of the drive system.

14. The downhole ranging method as defined in paragraphs 12 or 13, wherein the ranging magnets are positioned in a pad assembly of the drive system or above the pad assembly of the drive system; or the ranging magnets are positioned on a stabilizer sleeve of the drive system.

15. The downhole ranging method as defined in any of paragraphs 12-14, wherein the ranging magnets are positioned on a flex collar of the drive system; or the ranging magnets are positioned in a flex collar positioned above a stabilizer sleeve, the flex collar being a rigid sub.

16. The downhole ranging method as defined in any of paragraphs 12-15, wherein the drive system is a push-the-bit rotary steerable system ("RSS").

17. The downhole ranging method as defined in any of paragraphs 12-16, wherein the magnets are positioned in a collar above the RSS.

18. The downhole ranging method as defined in any of paragraphs 12-17, wherein the drive system is a downhole motor assembly.

19. The downhole ranging method as defined in any of paragraphs 12-18, wherein the magnets are positioned on a bit box, drive shaft, bearing assembly, bent housing assembly or a stator tube of the downhole motor assembly.

20. The downhole ranging method as defined in any of paragraphs 12-19, wherein the ranging magnets are located in two or more subs positioned above and below the drive system; and a frequency of the subs is altered through rotational engagement and disengagement of the subs, thereby altering the frequency of magnetic fields generated by the subs.

Moreover, the methods described herein may be embodied within a system comprising processing circuitry to implement any of the methods, or a in a non-transitory computer-readable medium comprising instructions which, when executed by at least one processor, causes the processor to perform any of the methods described herein.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A downhole ranging tool, comprising:

a tubular string having a bottomhole assembly ("BHA") comprising a drive system and a drill bit; and one or more ranging magnets positioned along the tubular string, wherein at least one of the one or more ranging magnets is positioned between a drill bit box and push pads of the drive system, wherein the downhole ranging tool is configured to alter at least one magnetic field frequency of the one or more ranging magnets by changing between multiple rotation methods, comprising:

rotation of the tubular string alone, rotation of the drive system alone, and a combination of the rotation of the tubular string and the drive system.

2. The downhole ranging tool as defined in claim 1, wherein the one or more ranging magnets comprises two or more ranging magnets, and wherein:

at least one of the two or more ranging magnets is positioned in a pad assembly of the drive system or above the pad assembly of the drive system; or at least one of the two or more ranging magnets is positioned on a stabilizer sleeve of the drive system; or at least one of the two or more ranging magnets is positioned in a drill box of the drive system.

3. The downhole ranging tool as defined in claim 1, wherein the one or more ranging magnets comprises two or more ranging magnets, and wherein:

at least one of the two or more ranging magnets is positioned on a flex collar of the drive system; or at least one of the one or more ranging magnets is positioned in a flex collar positioned above a stabilizer sleeve.

4. The downhole ranging tool as defined in claim 1, wherein the drive system is a push-the-bit rotary steerable system ("RSS").

5. The downhole ranging tool as defined in claim 4, wherein the one or more ranging magnets comprises two or more ranging magnets, and wherein at least one of the two or more magnets is positioned in a collar above the RSS.

6. The downhole ranging tool as defined in claim 1, wherein the drive system is a downhole motor assembly.

7. The downhole ranging tool as defined in claim 6, wherein the magnets are positioned on a bit box, a drive shaft, a bearing assembly, a bent housing assembly, or a stator tube of the downhole motor assembly.

8. The downhole ranging tool as defined in claim 1, wherein at least one of the one or more magnets is embedded in a pocket of a side wall of the tubular string, the pocket being offset from a center line of the tubular string.

9. The downhole ranging tool as defined in claim 8, wherein the pocket is oriented laterally with respect to an axis of the tubular string.

10. The downhole ranging tool as defined in claim 1, wherein the one or more ranging magnets comprises two or more ranging magnets, and wherein:

the two or more ranging magnets are located in two or more subs positioned above and below the drive system; and a frequency of the subs is altered through rotational engagement and disengagement of the subs, thereby altering the frequency of magnetic fields generated by the subs.

11. A downhole ranging method, comprising:

generating, by way of two or more ranging magnets positioned along a tubular string in a first wellbore, one or more magnetic fields;

measuring the one or more magnetic fields using one or more sensors in a second wellbore; and determining, from the measuring of the one or more magnetic fields, distance of the first wellbore relative to the second wellbore, wherein:

one or more of the ranging magnets are located between a drill bit box and push pads of a drive system;

at least one frequency of the one or more magnetic fields is based on rotation of the tubular string in combination with rotation of the drive system.

12. The downhole ranging method as defined in claim 11, wherein:

at least one of the two are more ranging magnets is positioned in a drill bit box of the drive system; or at least one of the two or more ranging magnets is positioned between a drill bit box and push pads of a drive system of the tubular string.

13. The downhole ranging method as defined in claim 11, wherein:

at least one of the two or more ranging magnets is positioned in or above a pad assembly of a drive system of the tubular string; or at least one of the two or more ranging magnets is positioned on a stabilizer sleeve of the drive system of the tubular string.

14. The downhole ranging method as defined in claim 11, wherein:

at least one of the two or more ranging magnets is positioned on a flex collar of a drive system; or at least one of the two or more ranging magnets is positioned in a flex collar positioned above a stabilizer sleeve, the flex collar being a rigid sub.

15. The downhole ranging method as defined in claim 11, wherein the drive system is a push-the-bit rotary steerable system ("RSS") or a downhole motor assembly.

16. The downhole ranging method as defined in claim 15, wherein at least one of the two or more ranging magnets is positioned in a collar above the RSS.

17. The downhole ranging method as defined in claim 11, wherein at least one of the two or more magnets is positioned on a bit box, a drive shaft, a bearing assembly, a bent housing assembly, or a stator tube of a downhole motor assembly.

18. A downhole ranging tool, comprising:

a tubular string having a bottomhole assembly ("BHA") comprising a drive system and a drill bit; and one or more ranging magnets positioned along the tubular string, wherein at least one of the one or more ranging magnets is positioned between a drill bit box and push pads of a steering collar, and wherein the drive system comprises a push-the-bit rotary steerable system.

19. The downhole ranging tool of claim 17, wherein at least one of the ranging magnet is positioned in a bore machined into a body of the tubular string.

20. The downhole ranging tool of claim 19, wherein at least one of the one or more ranging magnets is positioned along a drive motor.

* * * * *